United States Patent [19]

Keppler

[11] Patent Number: 4,797,656

[45] Date of Patent: Jan. 10, 1989

[54] APPLIANCE PAGING SYSTEM

[76] Inventor: Charles N. Keppler, 498 Huntington Ave., Ventura, Calif. 93004

[21] Appl. No.: 146,714

[22] Filed: Jan. 21, 1988

Related U.S. Application Data

[63] Continuation-in-part of Ser. No. 7,905, Jan. 28, 1987, abandoned.

[51] Int. Cl.[4] ..... G08B 1/08

[52] U.S. Cl. ..... 340/539; 340/602; 340/309.15; 236/51; 34/50

[58] Field of Search ..... 340/539, 602, 309.15, 340/309.2, 309.3, 584, 586, 600, 640; 34/45, 53, 89, 50; 236/51

[56] References Cited

U.S. PATENT DOCUMENTS 3,116,982 1/1964 McIlvaine ..... 34/45

3,399,461 9/1968 Doty ..... 34/45

4,028,688 6/1977 Goleman ..... 340/539

4,195,288 3/1980 Morton ..... 340/539

*Primary Examiner*—Donnie L. Crosland

*Attorney, Agent, or Firm*—Marvin E. Jacobs

[57] ABSTRACT

A domestic appliance such as a clothes dryer having a signalling system including a portable radio receiver transportable by the appliance operator to locations remote from the operating cycle of said appliance to transmit a signal to said portable radio receiver to notify said operator that the operation of said appliance is completed. The system includes an adaptor for releasably and sealingly mounting the sensor unit within the flow exhaust air from the dryer, preferably with the sensing element covered by a screen. The adaptor has an inlet end attached to the exhaust fitment of the dryer and an outlet end attached to the outlet hose.

13 Claims, 2 Drawing Sheets

APPLIANCE PAGING SYSTEM

CROSS-REFERENCE TO RELATED APPLICATION

This application is a continuation-in-part of copending application U.S. Ser. No. 7,905 filed Jan. 28, 1987 now abandoned.

BACKGROUND OF THE INVENTION

This invention relates to home appliances, such as washers, dryers, etc. and is particularly directed to paging systems for announcing to an operator that the appliance has completed operating a cycle.

Washers and dryers have been considered to be standard home appliances for many years. More recently, it has become common for multiple housing complexes, such as apartment buildings, to provide several washers and dryers in a common laundry room which is available to all tenants of the complex. Similarly, laundromats contain a plurality of coin-operated washers and dryers which are available to the general public. These laundromats are frequently located in shopping centers or the like.

DESCRIPTION OF THE PRIOR ART

Many of the prior art washers and dryers have been provided with buzzers or lights to signal the operator when the appliance had completed its operation. Typical of the prior art systems are the U.S. patents to R. M. Sasnett, U.S. Pat. No. 3,050,864, issued Aug. 28, 1962; O. T. McIlvaine, U.S. Pat. No. 3,116,982, issued Jan. 7, 1964 and R. F. Doty, U.S. Pat. No. 3,399,461, issued Sept. 3, 1968. Audible and visual signals are effective when the operator remains in the vicinity of the appliance during operation of the machine. However, when the appliances are located in a multiple user area, such as an apartment laundry room or a laundromat, it is more usual than not that users will place their clothing in a machine, start the machine on its operating cycle and then leave to go shopping or perform other activities while the machine is operating and will return at a later time to remove their clothes from the machine. Unfortunately, this usually means that the machine completes its operation before the operator returns from his other activities. When this occurs, the machine must sit idly until the operator returns, which means a lack of utility of the machine and loss of profit to a laundromat owner. Alternatively, another person wishing to use the machine will remove the original operator's clothing from the machine and leave it on a nearby talbe or shelf. However, when this is done, the person removing the clothing does not often use the same degree of care in removing the clothing that the owner of the clothes would use. Thus, when the owner of the clothes returns, he may find the clothes mussed or even dirtier than they were originally. Furthermore, it is not uncommon for someone to steal some or all of the clothing before the owner returns.

Another important consideration in the operation of a dryer, whether in a multi-use facility or in a home or apartment, is the wasted energy expended in the operation of the appliance after the clothing has reached its optimum dryness. Even though most clothes dryers emit an audible signal on completion of a cycle, most clothes dryers are located in the garage or some remote place where you cannot hear the signal when the cycle is complete, or, when the machine shuts off.

Very often a person wants to take advantage of a nap when laundering but does not for fear of not waking in time before the machine shuts off. If this happened, the clothes would wrinkle if left unattended for even one (1) minute. It is estimated that dryers run eight (8) minutes per load beyond the time that the clothes are dry and ready to be removed. This computes to an estimated cost savings of $75.00/yr for a family of four (4) based on the following calculations:

GAS DRYER DATA

Average gas dryer uses 175 THERMS/load. At today's cost rate, this equals $0.60/load.

1 THERM = 100,000 BTUs
1,000 BTUs = 1 cu.ft. of natural gas
100 cu.ft. = 1 THERM It takes 5.71 gas dryer loads to equal 1 THERM.

Therefore:
5.71 loads/wk = 296.92 loads/yr
296.92 × 0.175 = 51.96 THERMS/yr
51.96 THERMS × 100 cu.ft. = 5196 cu.ft./yr
Estimate 8 minutes/load savings = 0.1333hr
Average 30 minutes/load − 0.5hr
0.1333 hrs. = 26.6% × 51.96 THERMS = 13.85 THERM saving = 1385.59 cu.ft. of natural gas saved per year per dryer.

If 10,000,000 families purchased this device, this computes to a savings of 13,850,000,000 cu.ft. of natural gas per year.

ELECTRIC DRYER DATA (Information based on Southern California Edison)

An electric dryer rated at 4850 watts uses 7.9 kw per month doing 26 loads. 7.9 kw × 12 months = 94.8 kw/yr.

8 minute savings/load = 26.6% (15 hrs/load).
26.6% × 7.9 = 2.10 kw × 12 months 25.21 kw savings/yr.
25.61 kw × 10,000,000 users = 252,100,000 kw hrs saved annually.

Since electric capacity in the United States is supplemented by hydroelectric plants using natural gas or oil to develop steam to operate the turbine-generators, the savings in energy will conserve a domestic resource and reduce dependency on the import of oil from foreign sources.

SUMMARY OF THE INVENTION

These disadvantage of the prior art are overcome with the improved signalling means for appliances of the present invention which permit the appliance to notify the operator, even in a remote location, that the appliance has completed its operation. This enables the operator to return promptly to recover his clothing, quickly frees the machine for a subsequent user and minimizes use of energy.

The advantages of the present invention are attained by providing an alarm system which senses completion of the operating cycle of an appliance and, in response thereto, transmits a signal to a portable receiver unit which can be carried by the operator of the appliance.

The remote cordless receiver to monitor when clothes are dry is a very useful and beneficial item. It can be carried in a pocket, clipped on your side, or, just set at a convenient place where it can be heard. In a preferred embodiment of the paging system of the invention the humidity sensor is mounted in the exhaust duct or an adaptor attached to the exhaust outlet. The paging system can be packaged as an attachment kit that can be added to any clothes dryer.

By use of the appliance paging system of the invention, the appliance and operator do not have to continually open and close the dryer door to check if clothes are dry. Allows freedom to tend to other duties, or nap, without being concerned that the dryer will shut off, and, as a result, clothes will wrinkle. One can set the timer and/or humidity sensor a maximum setting and depend on the signal to alert you when clothes are dry. The dryer will consume only enough electricity and natural gas necessary to dry the clothes. Delicate fabrics will not be exposed to "over" drying. The dryer motor and heating element will be utilized less therefore less maintenance/repair bills and will last longer. Considerable energy savings in natural gas and electricity are provided as would be reduction in air pollution related to less combustion of oil to produce the saved electricity.

These and many other advantages and attendant features of the present invention will become apparent as the invention becomes better understood from the following detailed description when considered in conjunction with reference to the figures of the accompanying drawing.

DETAILED DESCRIPTION OF INVENTION

Figure 1:
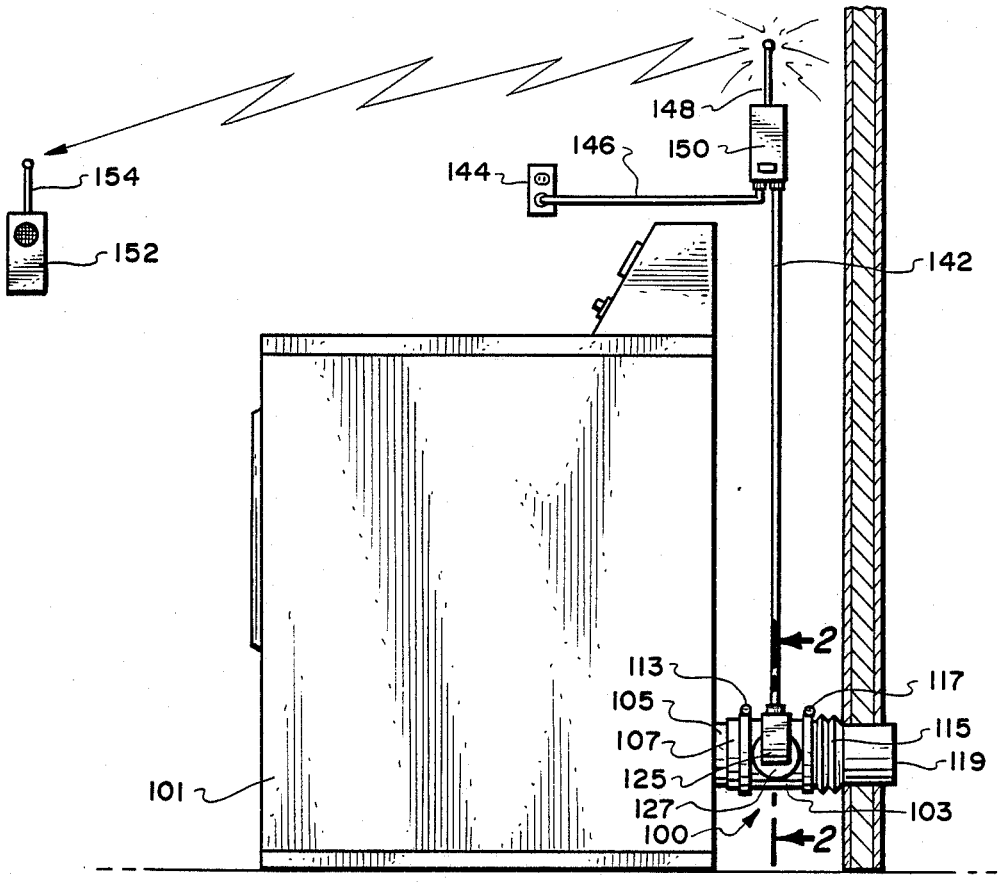
FIG. 1 is a side view of an embodiment of the dryer paging system of the invention.
Figure 2:
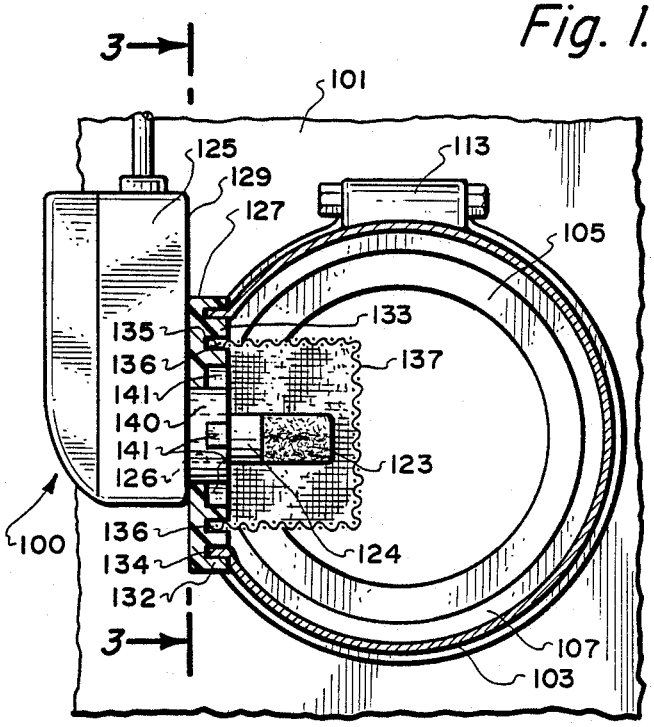
FIG. 2 is a cross-sectional view taken along line 2—2 of FIG. 1.
Figure 3:
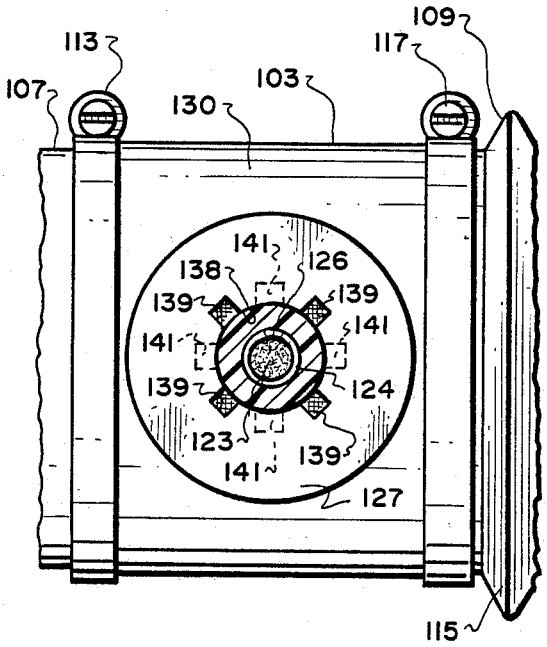
FIG. 3 is a further cross-sectional view taken along line 3—3 of FIG. 2.

A first embodiment of a dryer paging system is illustrated in FIGS. 1, 2, 3. In this embodiment, the humidity sensor unit 100 is mounted external to the dryer 101. The unit 100 is mounted on an adaptor 103 which attaches to the hot air, outlet fitment 105 of the dryer 101. The adaptor 103 has an inlet end 107 and an outlet end 109. The inlet end 107 preferably includes slits, not shown, which allows the adaptor, suitably formed of metal, to fit over or under the outlet fitment 105. The inlet end 107 is then sealed and rigidly connected to the fitment by means of a ring or band circular clamp 113. The outlet end 109 of the adaptor 103 is connected to an exhaust hose 115 such as a corrugated, covered wire hose by means of a further clamp 117. The other end of the hose 115 is connected to the wall vent 119.

The sensor unit 100 is mounted on the adaptor 103 in a manner to allow ready access to clean the sensor element 123.

The sensor element 123 is disposed in a holder 124 mounted in an axial bore 126 in the hub 140. A flat mounting plate 127, suitably formed of plastic, is attached to the central section 130 of the adaptor 103. A first circular groove 132 in the inside faces 133 of the plate 127 receives a cylindrical rim 134 formed on the central section 130 of the adaptor 103. A second circular groove 135 receives the inner edge 136 of a cup-shaped lint screen 137 which protects the sensor element 123 from the lint carried in the hot-air exhaust leaving the dryer 101.

The plate has a central circular channel 138 connected to a plurality of tangentially positioned, equally spaced, radial slots 139. A hub 140 containing a plurality of radial teeth 141 is attached to the inner face 129 of the housing 125. When the housing 125 is twisted, the teeth 141 lock in the mounting plate 127.

The signal from the unit 101 is sent to the transmitting unit 150 by means of a wire 142. The transmitting unit can be powered by battery or from an external source of power such as standard AC power receptacle 144 by means of power cord 146. The transmitting unit 150 sends the signal indicative of the end point humidity of the air through an antenna 148. The signal is received through the antenna 154 of the hand-held receiver unit 152.

A recommended humidity sensor is a duct mounted transmitter unit, Humicap HMP 122Y, which can be utilized in operation with a Humicap Relay Unit HMR 120. This unit utilizes a capacitive thin film sensor giving excellent accuracy and reliability of humidity reading based on the capacitive change in a 1 micron thin polymer film as it absorbs water vapor. These sensors give accuracy of ±2% RH with excellent response time and long-term reliability.

This after-market sensor unit can readily be added to existing dryers with standard tools and clamps. The unit is added to the dryer 101 by removing the clamp holding the existing exhaust hose 115. The inlet end 107 of the adaptor is slid over or into the outlet fitment 105 of the dryer 101 and the belt clamp 113 is installed. The hose 115 is then reattached to the outlet end 109 of the adaptor by means of a further clamp 117. The sensor unit 100 is placed over the aperture 138 in the plate 127 with the radial teeth 141 on the hub 140 facing the slots 139 in the mounting plate 127. The sensor unit is twisted to lock the unit in place. The screen 137 had been preinstalled in the inner groove 135 on the adaptor plate 127.

Figure 4:
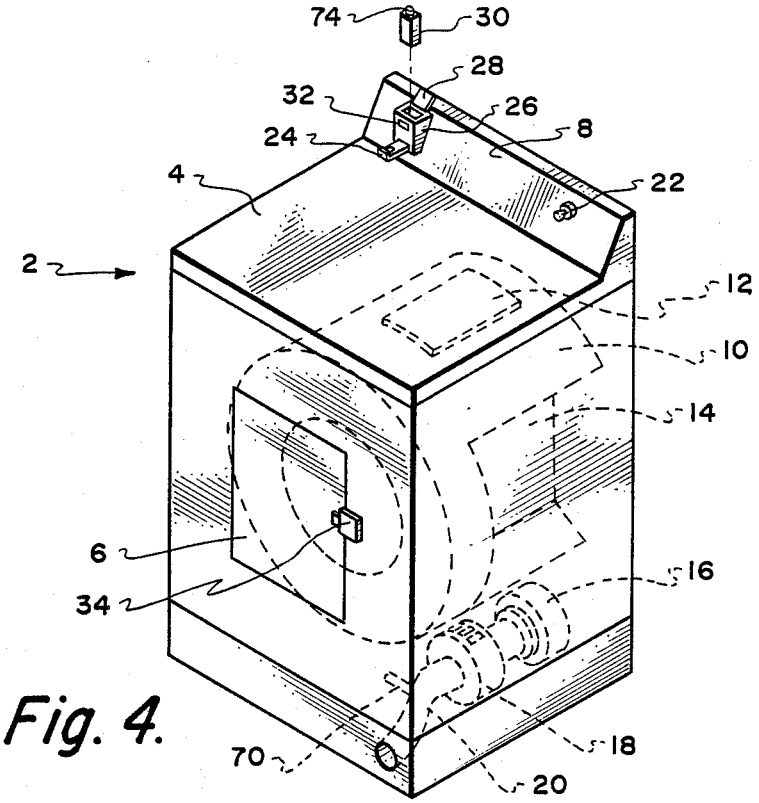
FIG. 4 is a diagrammatic representation of a laundry appliance, shown largely in phantom, having an alarm system embodying the present invention.
Figure 5:
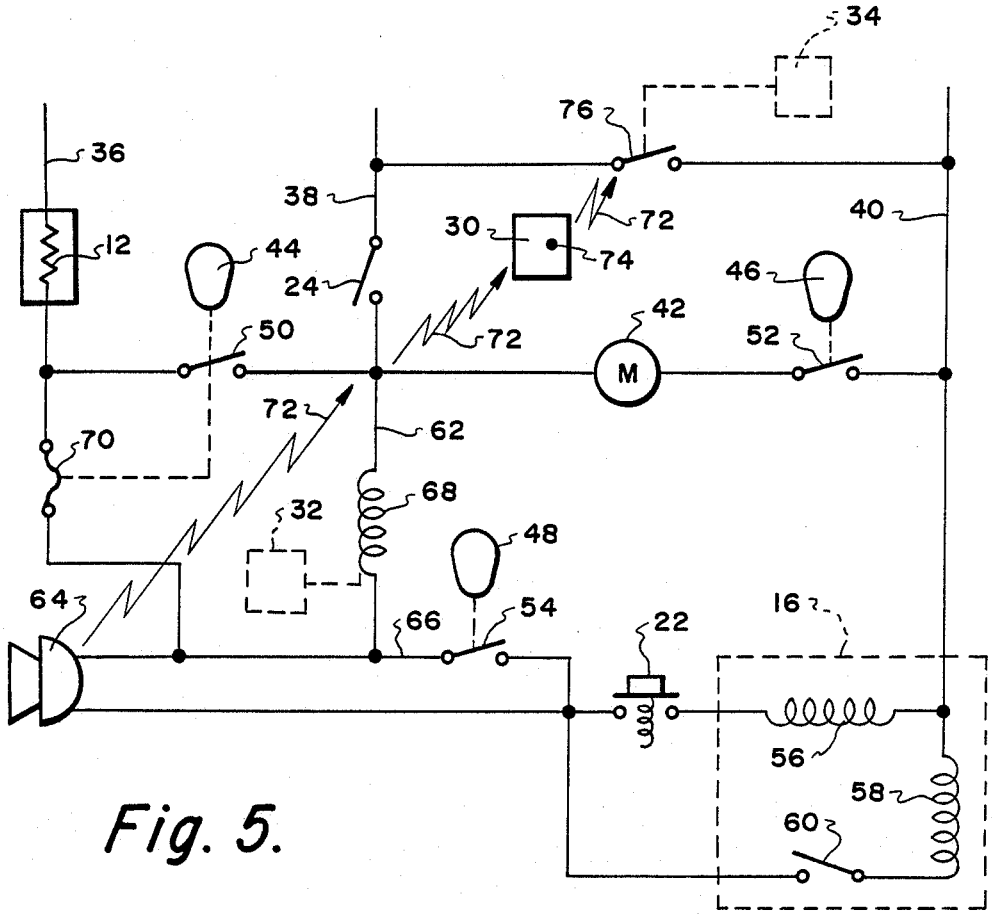
FIG. 5 is a diagrammatic representation of the electrical circuit of the appliance of FIG. 1.

A second embodiment of the present invention is shown in FIGS. 4–5. FIG. 4 shows an automatic clothes dryer, indicated generally at 2, having a housing 4 with a door 6 and a control panel 8. Within the housing 4 are a rotatable drum 10, a heating unit 12, an exhast header 14, a motor 16 for driving the drum 10, an exhaust fan 18 and an exhaust duct 20. On the control panel 8 are a start button 22, a coin-actuated switch 24 and a generally rectangular container 26 having a lid 28 for releasably retaining a portable receiver 30. The container 26 is provided with a manually-engageable, solenoid-releasable lock 32 for retaining the lid 28 in its closed position. A similar lock 34 is provided on the housing 4 and serves to retain the door 6 in its closed position.

FIG. 5 is a diagrammatic representation of the system for energizing and controlling the dryer 2 of FIG. 4. As usual, the dryer 2 is energized across a three wire electrical system including supply conductors 36 and 38 and a neutral conductor 40. Conventionally, a voltage of 220 volts is applied between the conductors 36 and 38 and a voltage of 110 volts is provided between the neutral conductor 40 and either of the supply conductors 36 and 38. Actuation of the entire control system is under the control of the coin-actuated switch 24. Obviously, if the present invention is intended for use in a home appliance, the coinactuated switch 24 may be replaced by a simple manual switch.

A timer motor 42 is connected between supply conductor 38 and the neutral conductor 40 and controls cams 44, 46 and 48, rotating the cams at a slow rate to control cam switches 50, 52, 54 so as to provide a full operating cycle for the dryer 2. However, switches 50, 52 and 54 are initially closed by operation of the coin-actuated switch 24. Cam switch 50 controls the operation of the heater 12 which is energized when switches 24 and 50 are closed. Switch 52 controls the energization of timer motor 42. Neutral conductor 40 is connected to the junction of the run winding 56 and start winding 58 of motor 16. Preferably, motor 16 will be a low-impedence induction-type motor having the run winding 56 continuously in the circuit while the dryer 2 is operating. The start winding 58 is connected in the circuit only briefly, at the beginning of operation, to effect starting of the motor 16 and then, as the motor 16 comes up to speed, speed actuated switch 60 serves to deenergize the start winding 58 and motor 16 operates thereafter on the run winding 56 alone.

The windings 56 and 58 of motor 16 are connected to supply conductor 38 through conductor 62 and either a highimpedence device, such as radio transmitter 64, or a shunt circuit 66 which includes cam switch 54. Conductor 62 also includes solenoid 68 which, when actuated, serves to release lock 32 to permit removal of the portable radio receiver 30 from container 26. As noted above, the control system is energized by actuation of the coin-actuated switch 24. However, initiation of the actual operation is controlled by the manually-actuated start button 22. Finally, a humidity sensing device 70 is preferably mounted to sense the moisture content of the air in the exhaust duct 20 and serves, when the humidity falls below a predetermined value, to trigger the radio transmitter 64 and to shut off the heater 12.

In use, an operator opens door 6, deposits the laundry to be dried in the drum 10 of the dryer 2 and closes door 6 which causes the manually-operated lock 34 to engage and prevents unauthorized removal of the clothing from the dryer 2. The operator then places the required coins in the coinactuated switch 24 and actuates the switch 24 to energize the control system. Then, the operator depresses start button 22 to initiate the operation.

Actuation of the start button 22 energizes the windings 56 and 58 of motor 16 and actuates solenoid 68 to release lock 32 and, hence, permit removal of the portable radio receiver 30 from the container 26 on the control panel 8 of the dryer 2. The dryer 2 will now proceed to dry the clothing, while the operator takes the portable radio receiver 30 and is free to leave the laundry area and to perform various other activities at remote locations. When the dryer 2 has completed its operation, the timer motor 42 will cause cam 48 to open cam switch 54, breaking shunt circuit 66 and energizing radio transmitter 64 to send a message to the portable radio receiver 30, as indicated by arrows 72 in FIG. 2. It will be apparent to those skilled in the art that the signal from the radio transmitter 64 may be suitably coded so that its signal will only be detected by the corresponding portable radio receiver 30. Upon receipt of the signal from the radio transmitter 64, the portable radio receiver 30 provides an audible and/or visual signal to the operator to announce that the dryer 2 has completed its operation. The operator may then return to the laundry area and, by pressing button 74 of the portable radio receiver 30, can send a signal to actuate solenoid switch 76 to release the lock 34 on door 6 of the dryer 2. Until the operator presses button 74 to actuate the solenoid switch 76, the door 6 of the dryer 2 will remain locked, thereby preventing unauthorized removal of the operator's clothing from the dryer.

As is well known, the time required to dry any given load of clothing will vary greatly depending upon the material of the clothing, the size of the load, etc. Obviously, the timing motor 42 can only determine the time required to perform an average drying operation. However, where small loads or fast-drying materials are involved, this may result in unnecessarily long drying periods. This is wasteful of the energy required to operate the dryer 2 and causes delays in freeing the dryer 2 for use by subsequent operators which is costly to the laundromat owner. These disadvantages are overcome by the inclusion of the humidity sensing device 70. As noted above, the humidity sensing device 70 determines when the moisture content of the air in the exhaust duct 20 has fallen below a predetermined value and, when this occurs, the humidity sensing device 70 acts to trigger the radio transmitter 64 and to shut off the heater 12 by opening switch 50. This prevents waste of energy by the heater 12 and notifies the operator that his clothing is ready.

If desired, the signal button 74 may be omitted from the portable radio receiver 30 and switch 76 may be actuated by a manual switch operable, for example, by replacement of the portable radio receiver 30 within the container 26 and closure of the lid 28 of the container 26, thereby assuring return of the portable radio receiver 30 by the operator. Should the operator delay returning for his clothing within a predetermined period, additional coins would be required to actuate the door lock 34. Furthermore, it will be apparent that the present invention would be equally applicable to washing machines and other appliances.

It is to be understood that numerous other variations and modifications can obviously be made without departing from the present invention. Therefore, it should be clearly understood that the form of the present invention described above and shown in the accompanying drawings is illustrative only and is not intended to limit the scope of the present invention.

I claim:

1. A humidity sensing unit for a clothes dryer comprising in combination:

an adaptor having an inlet end adapted for sealing attachment to an exhaust air fitment of a laundry dryer;

a humidity sensing unit mounted on said adaptor with a sensor element disposed within the adaptor for developing a signal indicative of moisture content of the exhaust air leaving the dryer;

a transmitter for receiving and broadcasting said signal; and a hand-held receiver for receiving said broadcast signal and for generating an audible or visual signal indicative of an end of a cycle of drying.

2. A unit according to claim 1 in which the inlet end of the adaptor contains slits for expanding or contracting the size of the opening of the inlet end.

3. A sensing unit according to claim 2 in which the adaptor contains a cylindrical outlet end for attachment to an exhaust hose.

4. A sensor unit according to claim 3 in which the adaptor has an opening in the side wall for removably and sealingly receiving the sensor unit.

5. A sensor unit according to claim 4 further including a screen mounted on the inside of the adaptor over the sensor element.

6. A sensor unit according to claim 4 in which the unit contains a hub having a plurality of mounting elements and the adaptor contains a series of slots for receiving and engaging said elements.

7. A laundry dryer appliance including:

heater means for drying clothing within said appliance, timing means for controlling an operation cycle of said appliance, a humidity sensing device mounted in an exhaust of said appliance to measure the moisture content of air in the exhaust of said appliance and responsive to humidity below a preselected level to generate a signal, a transmitter for transmitting said signal and a portable radio receiver receiving said transmitted signal and generating an audible signal indicative of end of said cycle.

8. The appliance of claim 7 further comprising:

a door for permitting the operator to place articles inside said appliance, lock means on said appliance for preventing unauthorized removal of said articles, and release means operable by said portable radio receiver for opening said lock means to permit removal of said articles from inside said appliance.

9. The appliance of claim 8 further comprising:

coin-actuated switch means for energizing said appliance, timing means connected in parallel with said release means operable after a predetermined interval to require insertion of additional coins in said coin-actuated switch before permitting actuation of said release means.

10. The appliance of claim 9 further comprising:

signal transmitting means contained within said portable radio receiver, and means responsive to a signal from said portable receiver for actuating said release means.

11. The appliance of claim 7 further comprising:

a container for said portable radio receiver mounted on said appliance, a closure member for said container to permit insertion into and removal from said container of said portable radio receiver, manually-engageable lock means for securing said closure member to prevent unauthorized removal of said portable radio receiver from said container, and release means actuable upon energization of said appliance to disengage said lock means to permit removal of said portable radio receiver from said container.

12. The appliance of claim 9 further comprising:

switch means actuable upon return of said portable radio receiver to said container for actuating said doorlock release means to permit removal of articles from within said appliance.

13. The appliance of claim 7 further comprising:

said radio transmitter being coded to permit reception of signals therefrom only by the particular portable radio receiver associated with said appliance.

* * * * *